US006119680A

United States Patent [19]

Barritt

[11] Patent Number: 6,119,680

[45] Date of Patent: Sep. 19, 2000

[54] VENTILATION SYSTEM FOR AN APPLIANCE

[75] Inventor: William D. Barritt, Cleveland, Tenn.

[73] Assignee: Maytag Corporation, Newton, Iowa

[21] Appl. No.: 09/126,756

[22] Filed: Jul. 31, 1998

[51] Int. Cl.[7] ..... F24C 15/20; F24F 7/06; F24F 7/007

[52] U.S. Cl. ..... 126/299 D; 126/299 R; 126/300

[58] Field of Search ..... 126/21 R, 21 A, 126/299 R, 299 D, 299 E, 300, 301, 302, 303; 55/DIG. 36; 237/47; 236/51; 454/290, 329

[56] References Cited

U.S. PATENT DOCUMENTS

| | | | |
|---|---|---|---|
| 4,105,422 | 8/1978 | Kiguchi . | |
| 4,109,641 | 8/1978 | Hunzicker . | |
| 4,134,394 | 1/1979 | Otenbaker . | |
| 4,235,220 | 11/1980 | Hepner . | |
| 4,363,642 | 12/1982 | Stahl . | |
| 4,411,254 | 10/1983 | Field et al. . | |
| 4,413,610 | 11/1983 | Berlik . | |
| 4,484,563 | 11/1984 | Fritz et al. . | |
| 4,527,542 | 7/1985 | Bales et al. . | |
| 4,766,880 | 8/1988 | Von Blanquet . | |
| 4,846,146 | 7/1989 | Tucker et al. . | |
| 5,000,160 | 3/1991 | Dunlop et al. . | |
| 5,209,217 | 5/1993 | Beach et al. . | |
| 5,449,112 | 9/1995 | Heitman et al. | 236/51 |
| 5,533,668 | 7/1996 | Erikson | 236/51 |

FOREIGN PATENT DOCUMENTS

| | | | |
|---|---|---|---|
| 3245302 | 6/1984 | Germany | 126/299 R |
| 0095056 | 7/1980 | Japan | 236/51 |
| 403007836 | 1/1991 | Japan | 126/299 D |
| 405099463 | 4/1993 | Japan | 126/299 D |
| 406050592 | 2/1994 | Japan . | |
| 2086034 | 5/1982 | United Kingdom | 126/299 F |
| 2099607 | 12/1982 | United Kingdom | 236/51 |

OTHER PUBLICATIONS

Radio Shack Catalog, pp.–3 ad 137, 1994.

X–10 Powerhouse, X–10(USA) Inc., pp.–1–31, No Date.

*Primary Examiner*—Carl D Price

*Attorney, Agent, or Firm*—Everett G. Diederiks, Jr.

[57] ABSTRACT

A ventilation system for an appliance, such as a clothes dryer or a cooking device, includes a blower unit which is located remote from the appliance and connected to the appliance through an elongated duct. To control the operation of the blower unit, a transmitter is used to send signals to a receiver electrically connected to the blower unit. In accordance with certain preferred embodiments of the invention, radio frequency, ultrasonic or other similar types of signals are directed through the duct to the receiver. In accordance with another preferred embodiment, a power line transmitter is utilized. A method of remotely controlling the operation of the appliance ventilation system is also provided.

16 Claims, 4 Drawing Sheets

VENTILATION SYSTEM FOR AN APPLIANCE

BACKGROUND OF THE INVENTION

1. Field of the Invention

The present invention pertains to the art of appliances and, more particularly, to an appliance ventilation system incorporating a remotely located ventilation blower.

2. Discussion of the Prior Art

There exist various types of appliances, including clothes dryers and cooking units, which require a ventilation system. For instance, essentially every form of cooking produces smoke, steam or other gaseous byproducts. Often, some type of ventilation system is provided to evacuate the gaseous byproducts, either upwards through a venting hood or downward into a draught flue. Regardless of the particular form of venting, a blower unit is provided to direct and exhaust the gaseous byproducts.

Almost invariably, the blower unit of a ventilation system will be located at the appliance such that minimal ducting is used to direct the fluids to a suction or inlet side of the blower unit. On the other hand, a first end of an elongated, flexible duct is typically attached to an outlet side of the blower unit, with a second end of the elongated duct typically leading to the ambient environment. With such an arrangement, the controls for the blower unit are also located at the appliance such that limited electrical wiring is required for use in activating and deactivating the blower unit. Even if the blower unit is located somewhat remote from the appliance, the controls for the blower unit are still typically located at the appliance. Under these circumstances, the blower unit is hardwired from the controls at the appliance to the blower unit. Therefore, in addition to the elongated ducting from the appliance location, a fair amount of wiring is required. This wiring can be problematic and cumbersome to rout, especially if such a remote blower arrangement, or just new wiring therefor, is being retrofitted into an existing ventilation system or a new ventilation system is being installed in an existing building.

SUMMARY OF THE INVENTION

The present invention is directed to a ventilation system for an appliance, such as clothes dryers and cooking devices. The ventilation system includes a blower unit located remote from the appliance and interconnected to the appliance through suitable, elongated ducting. In order to control the operation of the blower unit, a transmitter is used to send signals to a receiver which is electrically connected to the blower unit.

In accordance with certain preferred embodiments of the invention, radio frequency, ultrasonic or other similar types of signals are directed through the duct to the receiver. Preferably, the transmitter has an associated antenna having a terminal end portion arranged in the duct, while the receiver has a corresponding antenna terminating in another end portion of the duct. In accordance with another preferred embodiment, a power line transmitter is utilized such that signals are sent from the transmitter to the receiver through existing wiring in a building. In any case, the blower unit and the receiver are located remote from the appliance so as to minimize the amount of dedicated wiring needed for the ventilation system.

The invention is also directed to a method of remotely controlling the operation of the appliance ventilation system. In any event, the use of the transmitter/receiver combination makes the ventilation system of the present invention easy to install, maintain and operate. Additional objects, features and advantages of the present invention will become more readily apparent from the following detailed description of preferred embodiments thereof when taken in conjunction with the drawings wherein like reference numerals refer to corresponding elements in the several views.

DETAILED DESCRIPTION OF THE PREFERRED EMBODIMENTS

Figure 1:
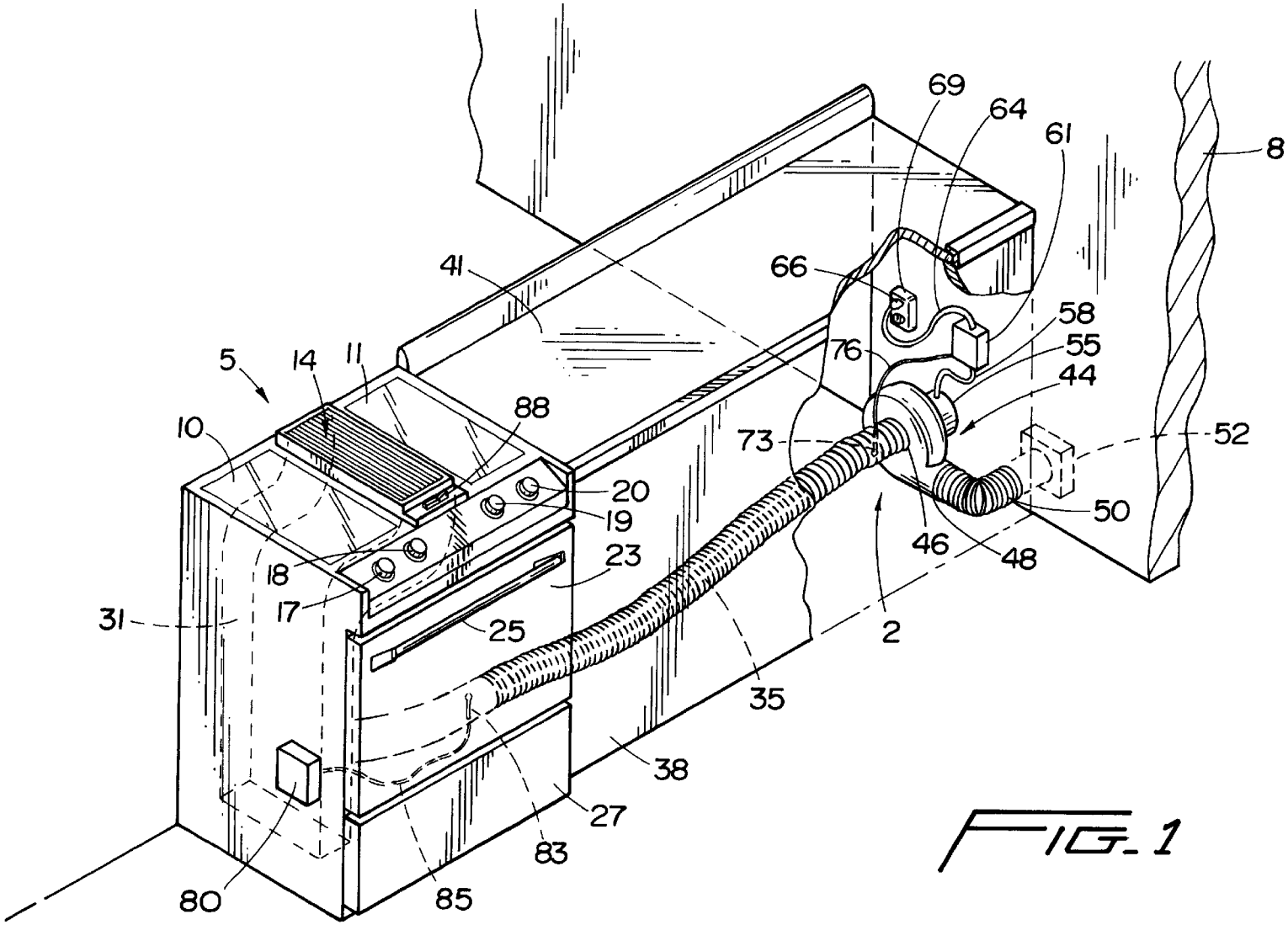
FIG. 1 is a perspective view of a downdraft range incorporating a ventilation system constructed in accordance with a first embodiment of the present invention.

With initial reference to FIG. 1, the ventilation system constructed in accordance with a first preferred embodiment of the invention is generally indicated at 2. As illustrated, ventilation system 2 is being utilized in connection with a downdraft grill-type range 5 which is located at a distance spaced from an exterior wall 8 within a building. In general, the construction and operation of grill-type range 5 is known in the art and therefore need not be detailed here. However, in general, range 5 includes interchangeable cooktops 10 and 11 which are located on either side of a venting inlet 14. The operation of range 5 can be controlled by adjusting one or more knobs 17–20. Range 5 is also provided with a door 23 having an associated handle 25 which enables access to an oven cavity (not separately shown). Below door 23 is provided an access panel 27.

Venting inlet 14 leads to a plenum or draught flue 31. An elongated duct 35 of ventilation system 2 has a first end which opens up into plenum 31. In general, duct 35 extends below the oven cavity of range 5 and can be accessed by removal of panel 27. Duct 35 also runs through a lowermost portion of cabinetry 38 located between range 5 and exterior wall 8. As shown, cabinetry 38 is provided with a countertop 41. Also mounted within the cabinetry 38 is a blower unit 44 of ventilation system 2. Blower unit 44 has an associated inlet 46 to which elongated duct 35 is attached such that inlet 46 is fluidly interconnected to plenum 31 and venting inlet 14. Blower unit 44 also includes an outlet 48 having attached thereto an exhaust duct 50 which extends through exterior wall 8 and terminates in a vent cap 52.

The particular construction of blower unit 44 is not considered part of the present invention. Instead, blower unit 44 is readily, commercially available and preferably constitutes a centrifugal blower incorporating an electric motor 55. Motor 55 is electrically connected through a cable 58 to a receiver 61 of ventilation system 2. A second electrical cable 64 is also wired to receiver 61 and has a terminal end plug 66 which is adapted to be inserted into a conventional electrical outlet 69. Receiver 61 also has associated therewith an antenna 73 which is preferably positioned within elongated duct 35 generally adjacent inlet 46 of blower unit 44. Antenna 73 is connected through a signal wire 76 to receiver 61.

Range 5 has mounted thereto a transmitter 80 which is linked to an associated antenna 83 through a wire 85. Transmitter 80 is interconnected to a switch 88 provided at top range 5 adjacent venting inlet 14. Although not shown in FIG. 1 for the sake of simplicity, it should be realized that switch 88 is electrically connected to both a source of electrical power and also to transmitter 80.

With this arrangement, when it is desired to activate ventilation system 2, switch 88 is manually depressed to activate transmitter 80. Alternatively, turning on range 5 through any of knobs 17–20 could be arranged to directly activate transmitter 80. In any event, transmitter 80 functions to develop control signals which are sent out through antenna 83. These signals are received by receiver antenna 73, relayed to receiver 61 and used to regulate the operation of blower unit 44. The use of transmitter 80 and receiver 61 obviates the need for dedicated wiring to blower unit 44, which can be located quite some distance from range 5. As will become more fully evident below, the specific manner in which transmitter 80 signals receiver 61 can vary without departing from the present invention. In accordance with this preferred embodiment, radio frequency signals are outputted by transmitter 80 in a manner generally analogous to conventional garage door-type signaling systems.

Although it is believed advantageous to arrange antennas 73 and 83 within elongated duct 35 to assure an unobstructed signal transmission, it should be understood that this is not a required mounting configuration. In addition, the mounting and location of receiver 61 and transmitter 80 can also vary greatly without departing from the spirit of the invention. For instance, receiver 61 can constitute a separate unit from blower unit 44 as shown in FIG. 1 or can be integrated with blower unit 44. On the other hand, transmitter 80 may be mounted to the exterior or interior of range 5, or even just adjacent range 5. Preferably, duct 35, antenna 83 and wiring 85 can be readily accessed from behind panel 27, with transmitter 80 being either located behind panel 27 or on the side wall of range 5 as shown in FIG. 1, with additional cabinetry being preferably provided on the left side of the range 5 of FIG. 1 in order to obstruct a direct view of transmitter 80.

Figure 2:
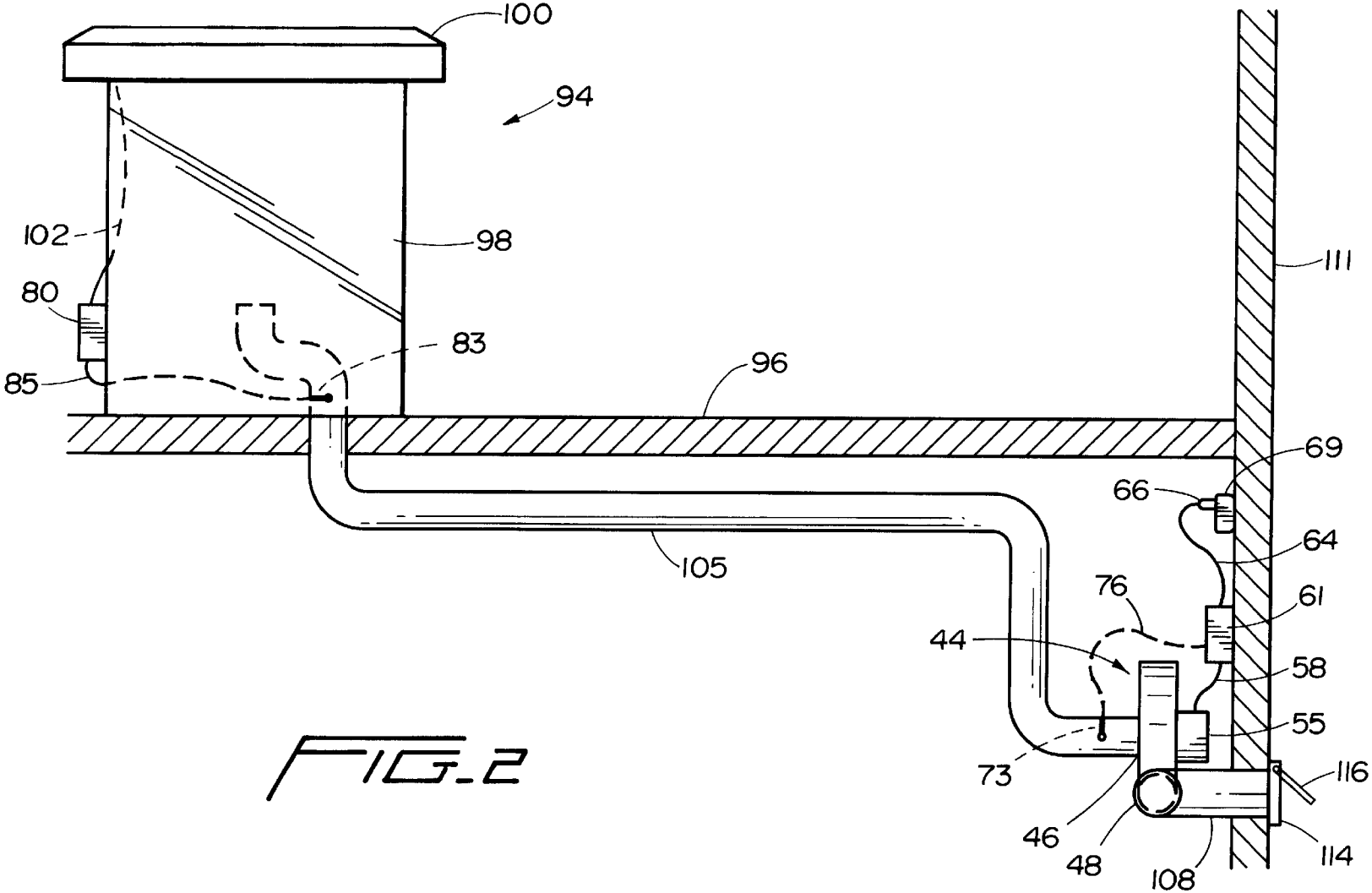
FIG. 2 illustrates a modified form of the ventilation system embodiment of FIG. 1 shown in combination with another type of cooking appliance.

FIG. 2 illustrates another potential application of the ventilation system of the present invention and like reference numerals have been used to refer to corresponding elements to that shown in FIG. 1 in this view. In accordance with this embodiment, an island 94 is supported upon a floor 96. Island 94 generally includes a lower cabinet 98 and a cooktop 100. As illustrated, wiring 102 extends from cooktop 100 to transmitter 80 and antenna 83 is suitably positioned within duct 105.

In the embodiment of FIG. 1, elongated duct 35 is illustrated to be generally flexible so as to enhance its routing through cabinetry 38. In the embodiment of FIG. 2, elongated duct 105 is shown to be generally rigid (e.g., PVC or metal tubing) and extends from lower cabinet 98, through floor 96 and to the inlet 46 of blower unit 44. Additional, generally rigid ducting 108 extends from the outlet 48 of blower unit 44 through an end wall 111 at which a venting cap 114, having a pivoting door 116, is provided. In general, the ventilation system of this embodiment functions substantially identical to that discussed above with respect to FIG. 1 and therefore details thereof will not be reiterated here. Instead, this Figure is merely intended to illustrate a different manner in which the ducting can be routed and to illustrate the ventilation system for use in connection with a different type of appliance.

Figure 3:
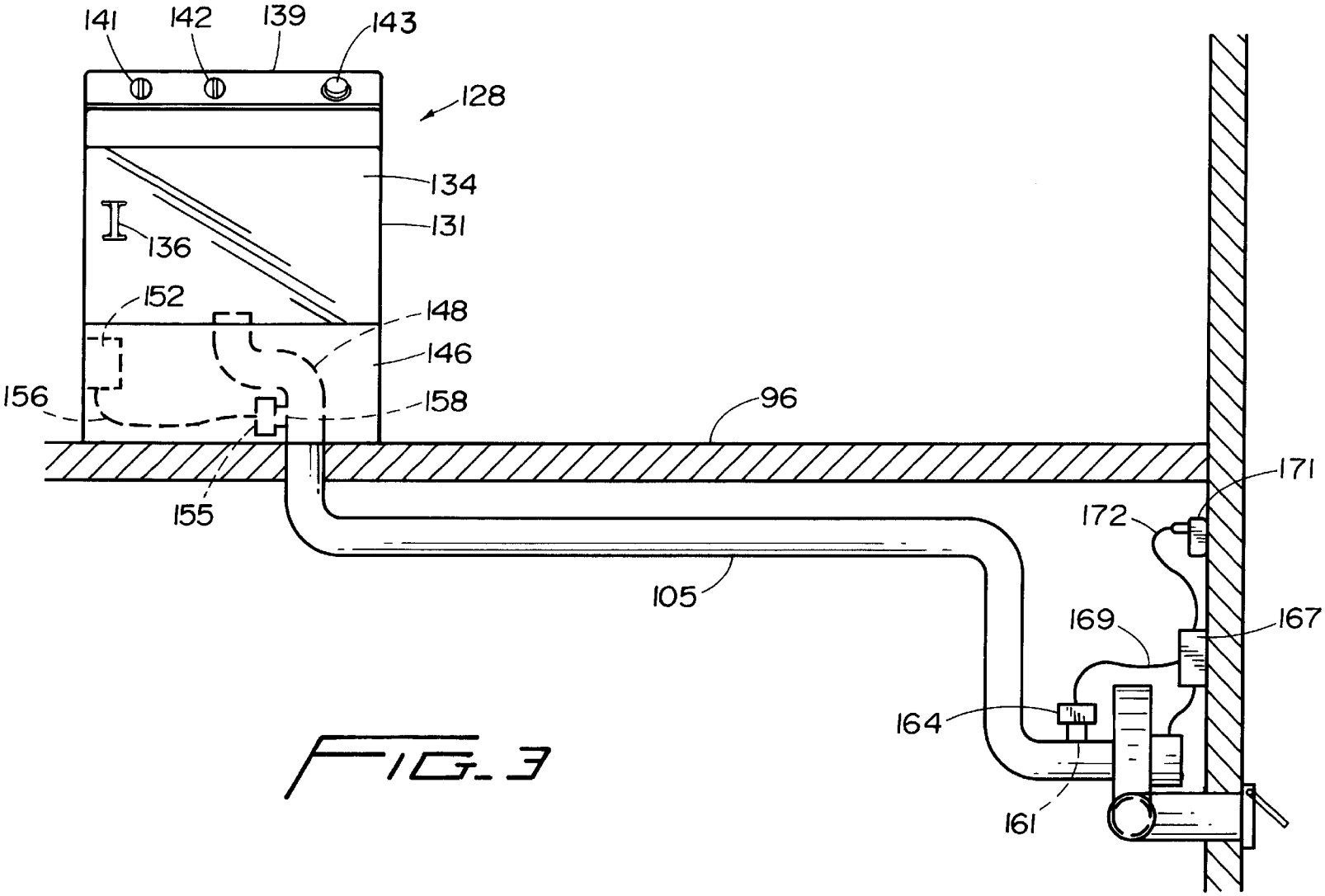
FIG. 3 illustrates a further appliance ventilation system embodiment according to the invention depicted in combination with a clothes dryer.

FIG. 3 illustrates another embodiment of the invention wherein the appliance to which the ventilation system is applied is shown to be a clothes dryer generally indicated at 128. As shown, clothes dryer 128 includes a cabinet shell 131 provided with a door 134 which can be pivoted by means of a handle 138 to provide access to an interior drum (not shown). Clothes dryer 128 has an associated control panel 139 provided with various knobs 141–143 which are used to set a desired cycle and to initiate the operation of clothes dryer 128. Below door 134, cabinet shell 131 has attached thereto an access panel 146 in a manner commonly known in the art. End portion 148 of duct 105 extends above floor 96 and is used in venting clothes dryer 128 in a manner generally known in the art.

However, it would be common in the art to mount blower unit 44 behind access panel 146. Instead, blower unit 44 is located remote from clothes dryer 128 and is fluidly connected to clothes dryer 128 through the elongated duct 105. To control the operation of blower unit 44, this embodiment provides an amplifier unit 152 which is mounted behind access panel 146 and linked to a transmitter 155 through wiring 156. In accordance with the embodiment, transmitter 155 constitutes an ultrasonic transmitter which preferably outputs signals in the order of 40 kHz. Transmitter 155 is mounted on a side opening 158 provided in end portion 148 of duct 105. In a similar manner, a side opening 161 is provided adjacent inlet 46 and has attached thereto a receiver 164. Receiver 164 is linked to a receiver amplifier 167 through wiring 169. Amplifier 167 is plugged into an electrical outlet 171 through a cable 172.

It should be readily apparent that the embodiment of FIG. 3 operates in a manner generally commensurate with the embodiments described above and that blower unit 44 can be selectively controlled based on signals received through a transmitter linked to the appliance.

Therefore, this embodiment merely illustrates another type of appliance to which the ventilation system of the present invention is applicable and also exemplifies how another type of transmitter/receiver arrangement can be utilized in accordance with the invention.

Figure 4:
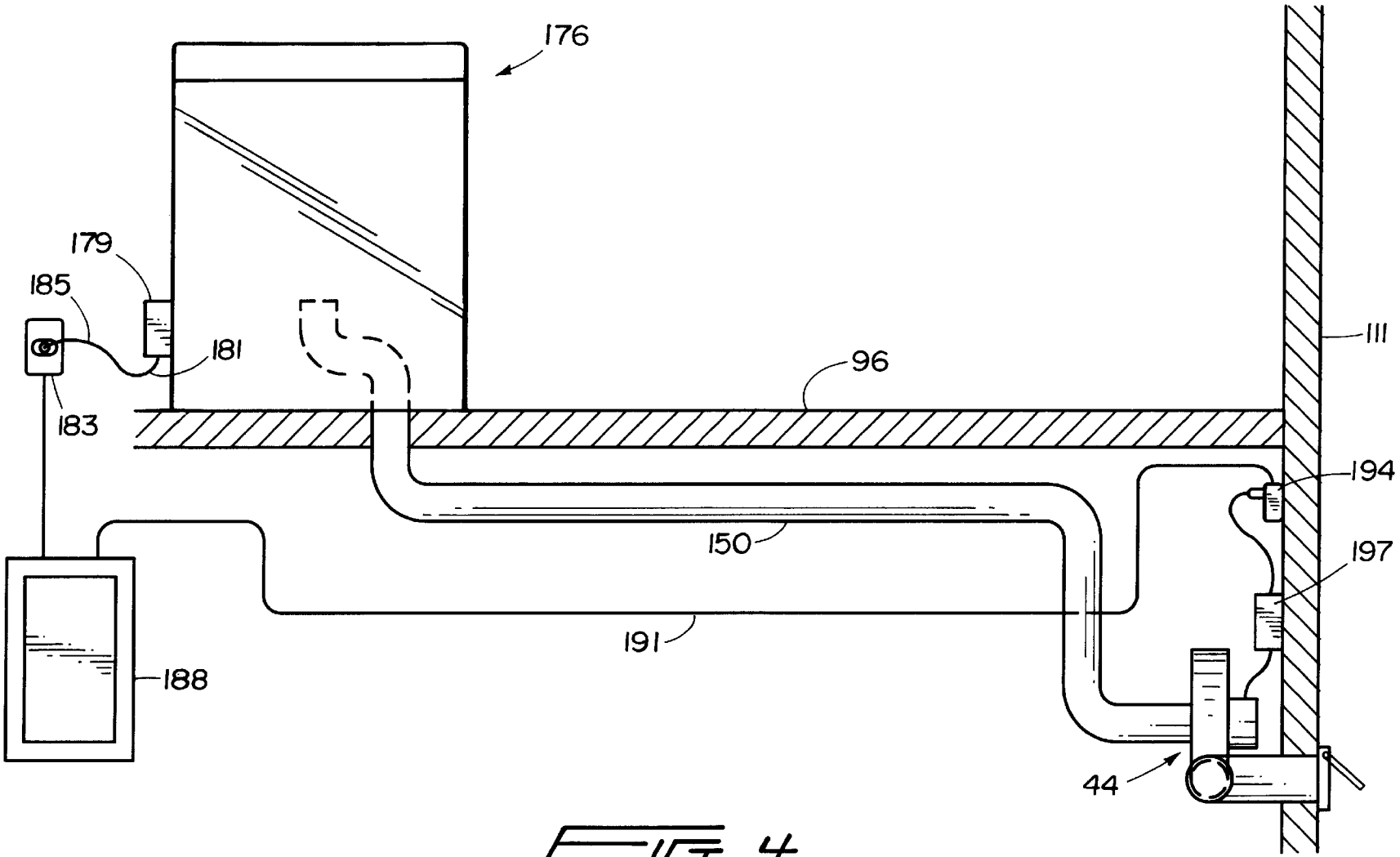
FIG. 4 depicts a still further appliance ventilation system embodiment of the invention.

FIG. 4 illustrates a still further embodiment of the invention designed to actuate blower unit 44 from a remote location without the use of dedicated wiring directly to the blower unit 44. Here, an appliance is generically represented at 176 and has associated therewith a transmitter 179. Transmitter 179 is plugged into an outlet 183 through wiring 185. Outlet 183 is electrically interconnected to a building circuit panel 188 which, in turn, is connected through wiring 191 to another outlet 194. A receiver 197 is plugged into outlet 194 and also electrically connected to blower unit 144. With this arrangement, signals used to control blower unit 44 can be sent from transmitter 179 to receiver 197 through the power lines already provided within the building in which appliance 176 is situated upon activation of appliance 176. Again, as with the embodiments described above, no specifically dedicated wiring is needed to remotely control blower unit 44 and therefore blower unit 44 can be located remote from appliance 176 without the need to rout wiring directly between appliance 176 and blower unit 44.

Based on the above, it should be readily apparent that various types of remote transmitting arrangements can be utilized in accordance with the present invention and each of these transmitting arrangements can be utilized with various types of appliances requiring ventilation. In each case, the ventilation blower is located remote from the appliance and connected to the appliance through an elongated duct, with the operating state of the ventilation blower being altered upon receipt of blower control signals which are outputted from a transmitter to a receiver electrically connected to the ventilation blower. Depending upon the type of signal transmission system utilized and the distance between the appliance and the blower unit, signal amplifiers or relays can be utilized. Therefore, although described with respect to preferred embodiments of the present invention, it should be readily understood that various changes and/or modifications can be made to the present invention without departing from the spirit thereof. In general, the invention is only intended to be limited by the scope of the following claims.

I claim:

1. A method of remotely controlling the operation of a ventilation blower located remote from an appliance and connected to the appliance through an elongated duct comprising:

outputting a blower control signal from a transmitter, including an antenna having an end portion terminating in the duct, through the duct; and altering an operating state of the ventilation blower upon receipt of the blower control signal by a receiver which is electrically connected to the ventilation blower.

2. The method according to claim 1, further comprising: activating the transmitter upon turning on the appliance.

3. The method according to claim 1, further comprising: outputting the blower control signal as an RF signal.

4. The method according to claim 1, further comprising: outputting the blower control signal as an ultrasonic signal.

5. The method according to claim 1, further comprising: amplifying the blower control signal emitted from the transmitter.

6. A ventilation system for an appliance comprising:

an appliance;

a blower unit mounted at a position remote from the appliance, said blower unit including an inlet and an outlet;

an elongated duct extending from the appliance to the inlet of the blower unit;

a transmitter for developing blower unit control signals, said transmitter constituting an ultrasonic transmitter attached at an opening provided in the duct; and a receiver electrically connected to said blower unit, said receiver being adapted to alter an operational state of the blower unit upon receipt of the control signals from the transmitter.

7. The ventilation system according to claim 6, wherein the transmitter includes an antenna adapted to direct the blower unit control signals to the receiver.

8. The ventilation system according to claim 7, wherein the transmitter antenna includes an end portion terminating in the duct.

9. A ventilation system for an appliance comprising:

an appliance;

a blower unit mounted at a position remote from the appliance, said blower unit including an inlet and an outlet;

an elongated duct extending from the appliance to the inlet of the blower unit;

a transmitter for developing blower unit control signals, said transmitter including an antenna adapted to direct the blower unit control signals to the receiver, with the transmitter antenna having an end portion terminating in the duct; and a receiver electrically connected to said blower unit, said receiver being adapted to alter an operational state of the blower unit upon receipt of the control signals from the transmitter.

10. The ventilation system according to claim 9, wherein the transmitter is mounted to the appliance.

11. The ventilation system according to claim 9, wherein the receiver also includes an antenna, with the receiver antenna extending into the duct.

12. The ventilation system according to claim 9, wherein the transmitter outputs RF blower unit control signals.

13. The ventilation system according to claim 9, wherein the transmitter comprises an ultrasonic transmitter.

14. The ventilation system according to claim 13, further comprising: a signal amplifier for the ultrasonic transmitter.

15. The ventilation system according to claim 9, wherein the appliance comprises a downdraft cooking device.

16. The ventilation system according to claim 9, further comprising: at least one control member of the appliance, wherein the transmitter is connected to the control member for activating the blower unit.

* * * * *